US007967634B1

(12) United States Patent
Hsia

(10) Patent No.: US 7,967,634 B1
(45) Date of Patent: Jun. 28, 2011

(54) JOINT STRUCTURE FOR A CABLE

(75) Inventor: Yvonne C. Hsia, Taichung (TW)

(73) Assignee: Fu Ching Technical Industry Co., Ltd., New Taipei (TW)

( * ) Notice: Subject to any disclaimer, the term of this patent is extended or adjusted under 35 U.S.C. 154(b) by 0 days.

(21) Appl. No.: 12/849,830

(22) Filed: Aug. 4, 2010

(51) Int. Cl.
*H01R 9/05* (2006.01)

(52) U.S. Cl. ..... 439/583; 439/271; 439/589

(58) Field of Classification Search ..... 439/578, 439/583–585, 271, 589, 462, 469, 321
See application file for complete search history.

(56) References Cited

U.S. PATENT DOCUMENTS 5,586,910 A * 12/1996 Del Negro et al. ..... 439/584
7,635,283 B1 * 12/2009 Islam ..... 439/583

* cited by examiner

*Primary Examiner* — Xuong M Chung Trans

(57) ABSTRACT

A joint structure for a cable contains a connecting sleeve including threads formed around an inner wall thereof and a shoulder extending on a bottom end of the inner wall thereof; an internal tube including an arresting ring extending around an upper end thereof and a circular groove arranged around an outer wall thereof; an outer fitting member including a hole disposed on a top surface thereof; a sheath member including an arrest rib extending around a bottom end thereof and a threaded section mounted around an inner wall thereof; a stopping loop including a plurality of resilient paws arranged around an upper end thereof and spaced apart from each other, the resilient paws being titled inward; a screwed sliding member including a screwed portion disposed around an outer wall thereof to screw with the threaded section of the sheath member.

12 Claims, 6 Drawing Sheets

JOINT STRUCTURE FOR A CABLE

BACKGROUND OF THE INVENTION

1. Field of the Invention

The present invention relates to a joint structure for a cable, and more particularly to a joint for a cable that is assembled easily and conveniently.

2. Description of the Prior Art

Cable is used to transmit image or electronic signal/data, and includes a joint disposed on a connecting end thereof to be fixed to an entry of an electronic device.

Conventional joint for the cable is comprised of a plurality of separated connecting components, and the connecting components are made of metal material. Therefore, the components of the joint can not be assembled easily because of high metal hardness, and they have to be assembled together by using an auxiliary tool. Besides, the components are made of metal material to enhance production cost.

The present invention has arisen to mitigate and/or obviate the afore-described disadvantages.

SUMMARY OF THE INVENTION

The primary object of the present invention is to provide a joint structure for a cable that is assembled easily and conveniently without using auxiliary tool.

Another object of the present invention is to provide a joint structure for a cable that is made of plastic material to lower production cost and time.

To obtain the above objectives, a joint structure for a cable provided by the present invention comprises a connecting sleeve formed in an annular tube shape, and including threads formed around an inner wall of an opening of an upper end thereof, and including a shoulder extending around a bottom end of the inner wall thereof;

an internal tube fitted to the connecting sleeve and formed in a hollowly elongated tube shape, and including an arresting ring extending outward around an upper end thereof to abut against the shoulder of the connecting sleeve, and including a circular groove arranged around an outer wall thereof;

an outer fitting member being a hollow housing, and including an orifice formed on a bottom end thereof, and including a hole disposed on a top surface thereof, the hole including a circular projection formed around an inner surface thereof to correspond to the circular groove of the internal tube such that the outer fitting member is fitted to the outer wall of the internal tube by using the hole and further enable to rotate the connecting sleeve;

a sheath member formed in a tube shape and used to plug into the orifice of the bottom end of the outer fitting member and inserted into the outer fitting member, including an arrest rib extending around a bottom end thereof to correspond to the bottom end of the outer fitting member, and including a threaded section mounted around an inner wall thereof;

a stopping loop fixed on a top end of the sheath member and formed in a hollowly circular tube shape, including a plurality of resilient paws radially arranged around an upper end thereof and spaced apart from each other, the resilient paws being titled inward;

a screwed sliding member formed in an elongated tube shape, including one end inserted into the sheath member and the stopping loop, including a screwed portion disposed around an outer wall thereof to screw with the threaded section of the sheath member so as to slide in the sheath member and the stopping loop, and when the screwed sliding member slides, it allows to selectively push the resilient paws of the stopping loop so that the resilient paws are expanded outward.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
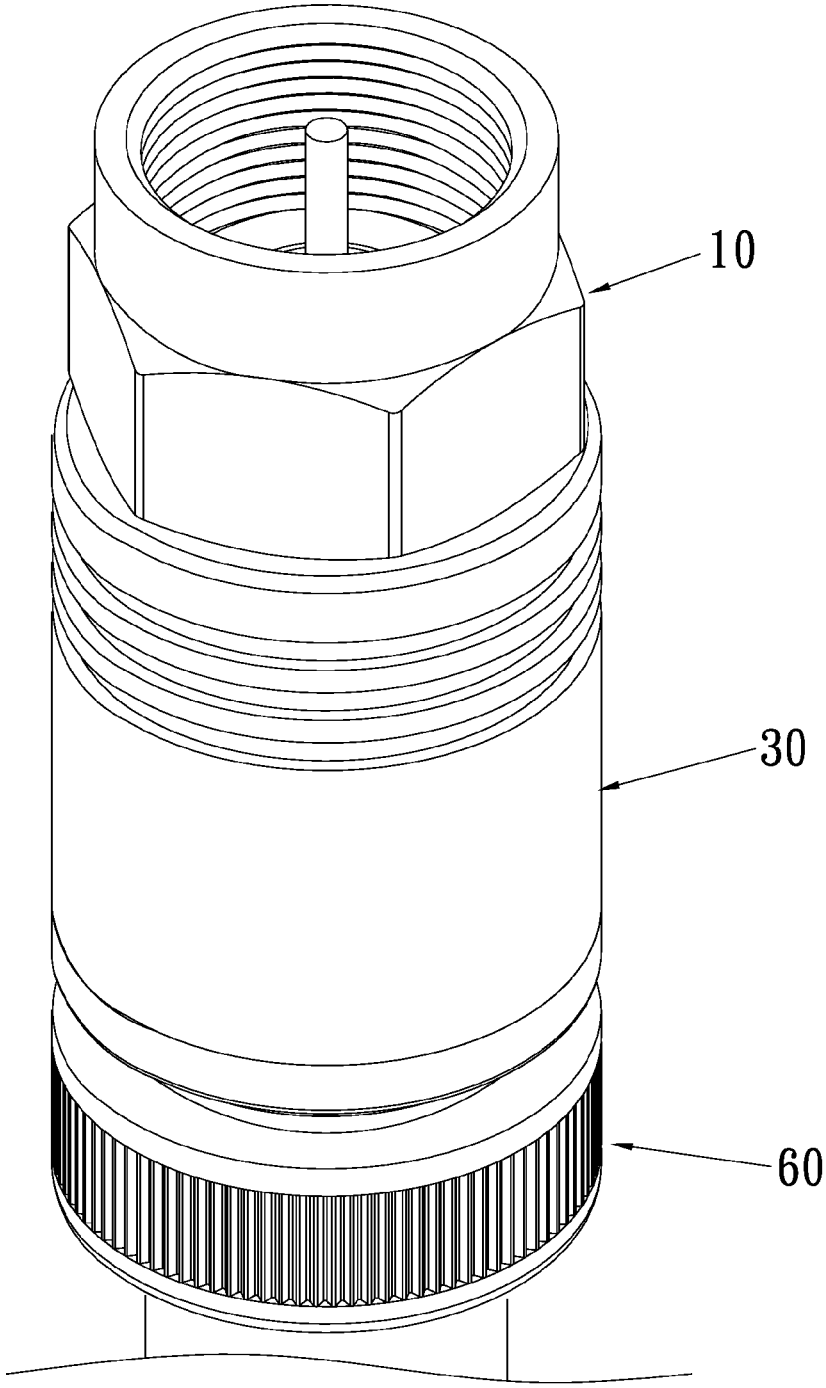
FIG. 1 is a perspective view showing the assembly of a joint structure for a cable according to a preferred embodiment of the present invention.
Figure 2:
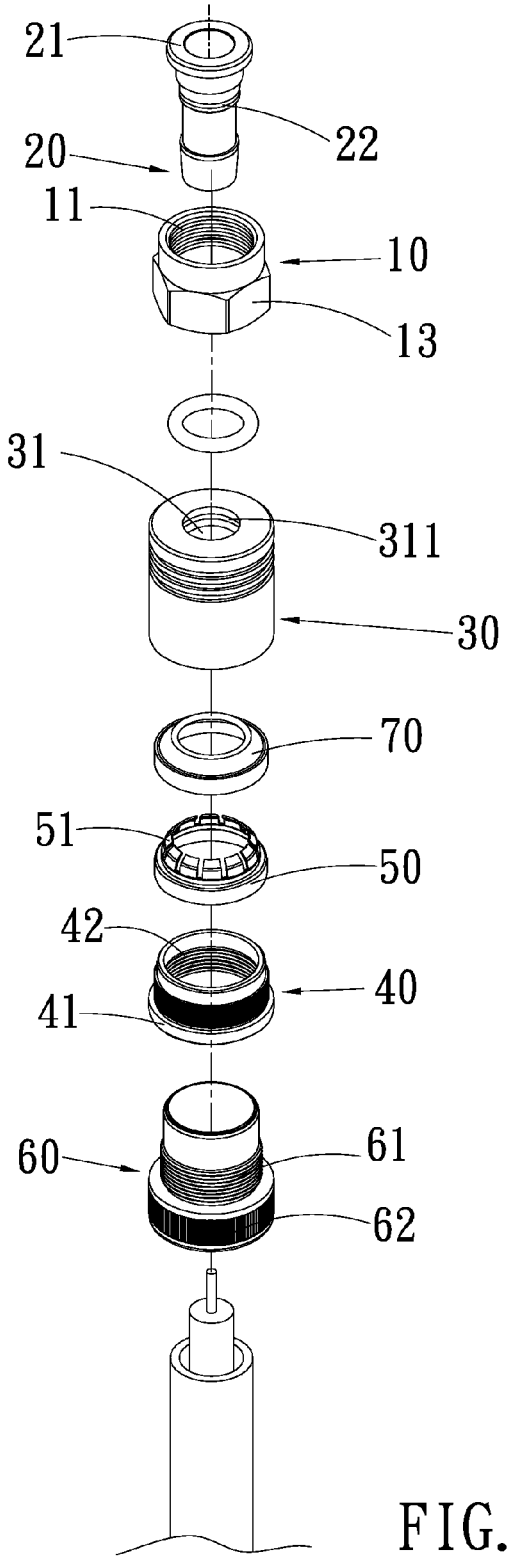
FIG. 2 is a perspective view showing the exploded components of the joint structure for the cable according to the preferred embodiment of the present invention.
Figure 3:
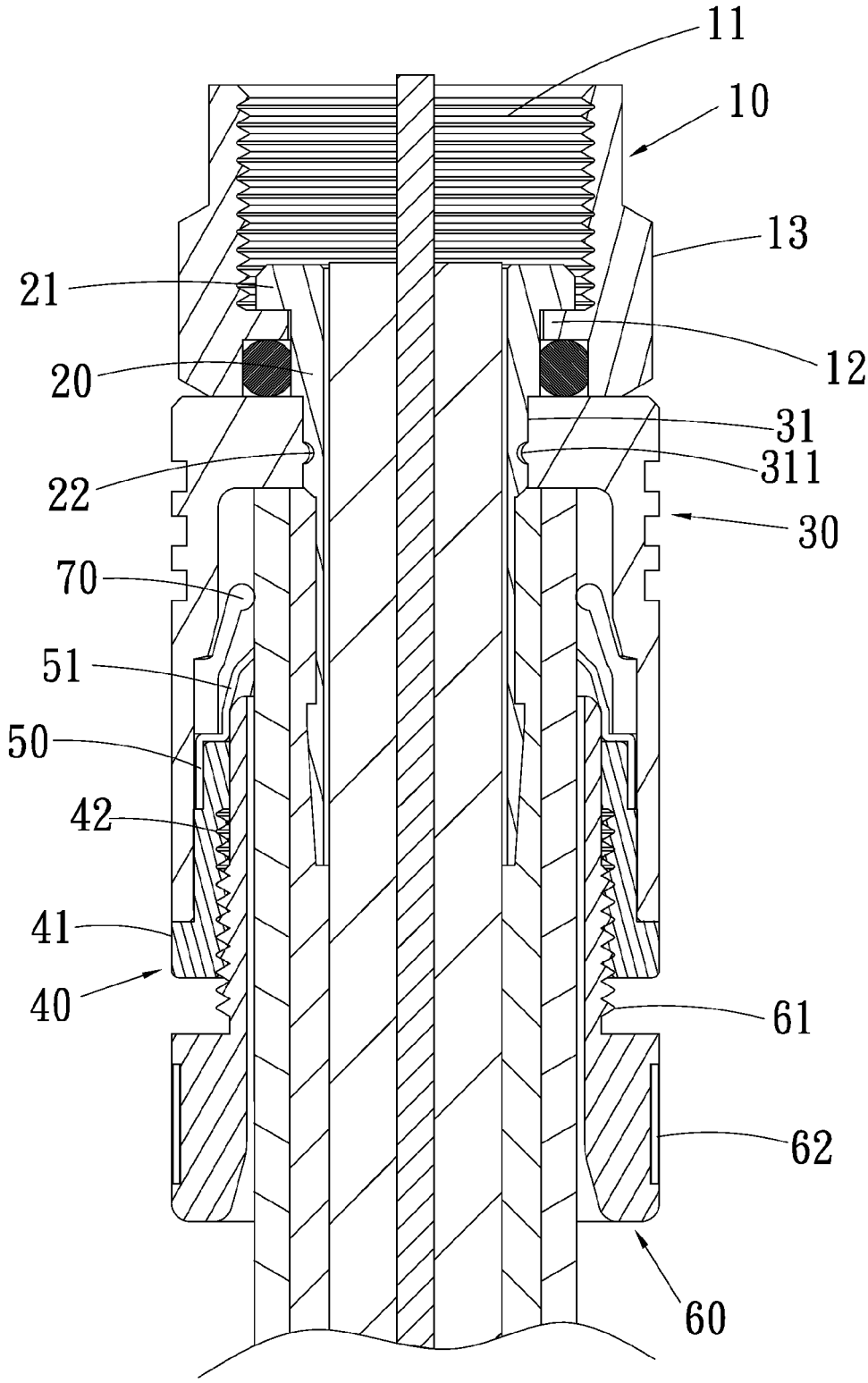
FIG. 3 is a cross sectional view showing of the assembly of a fixed cable according to the preferred embodiment of the present invention.
Figure 4:
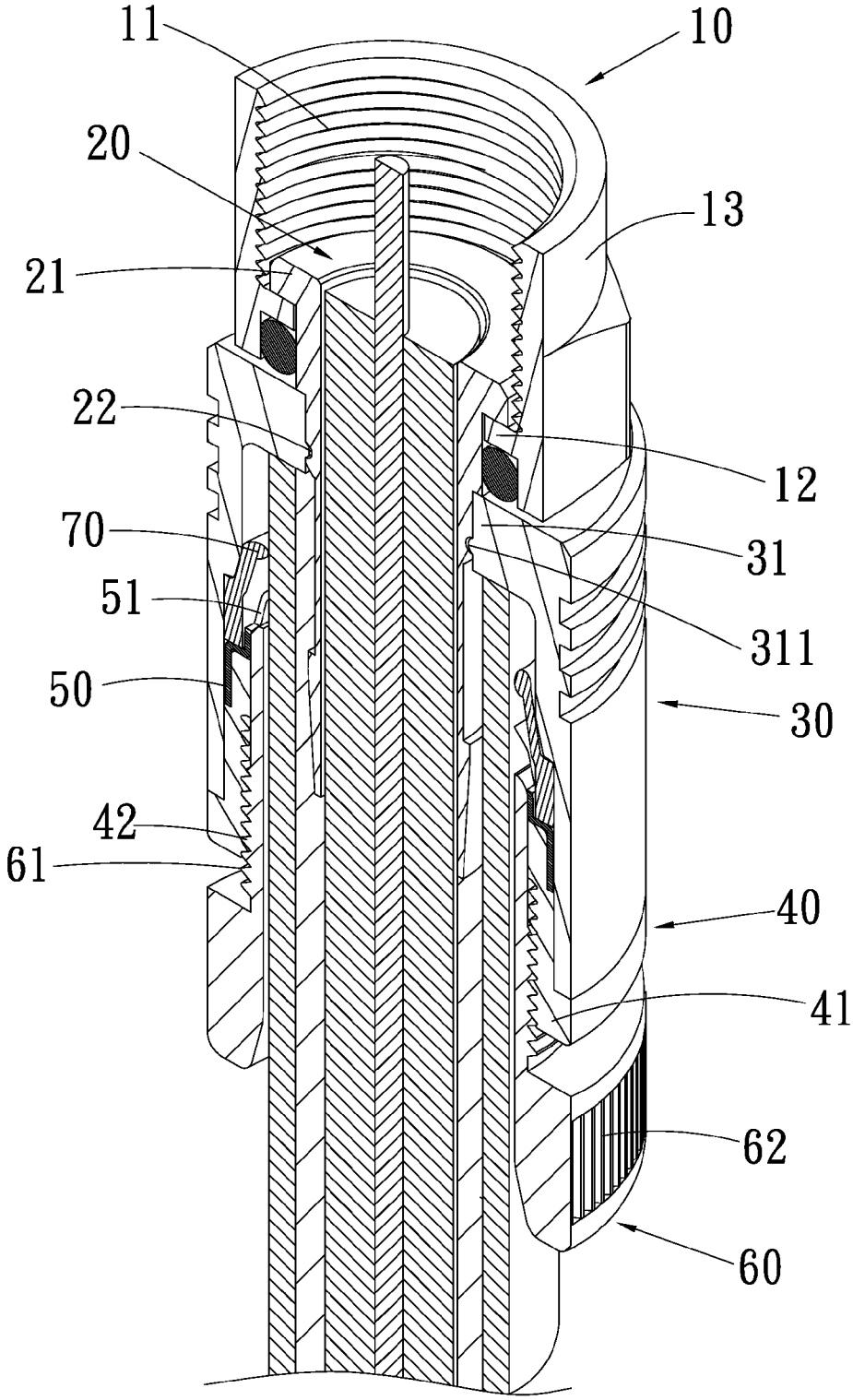
FIG. 4 is a perspective view showing the cross section of the fixed cable according to the preferred embodiment of the present invention.
Figure 5:
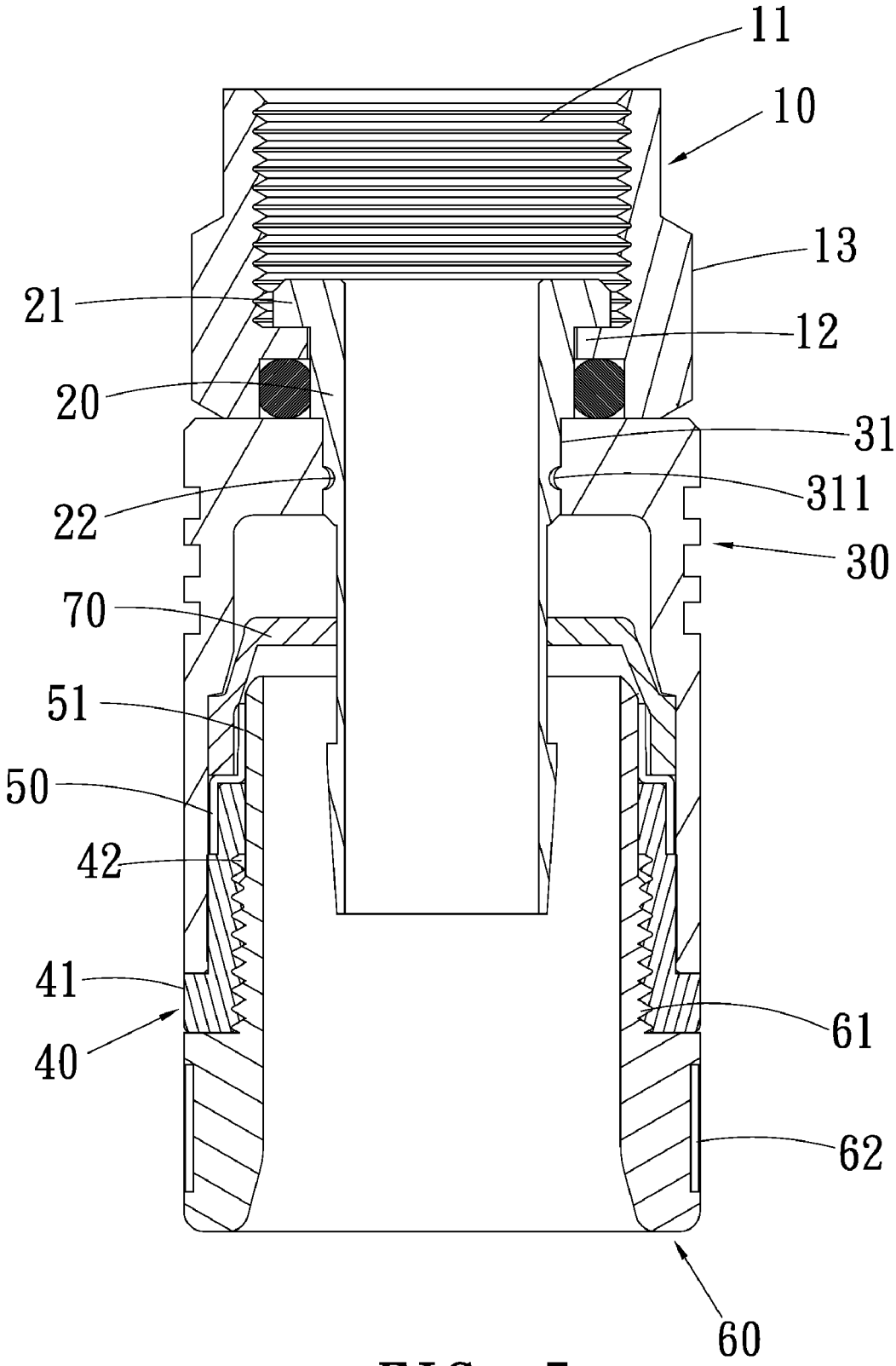
FIG. 5 is a cross sectional view showing of the assembly of an unfixed cable according to the preferred embodiment of the present invention.
Figure 6:
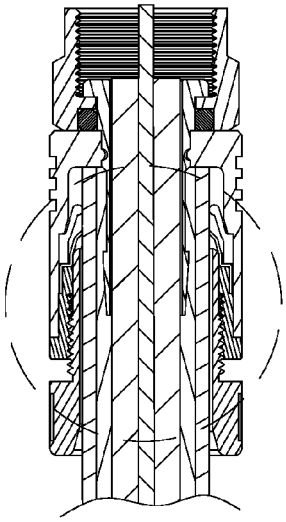
FIG. 6 is a cross sectional view showing a part of the fixed cable according to the preferred embodiment of the present invention.
Figure 6A:
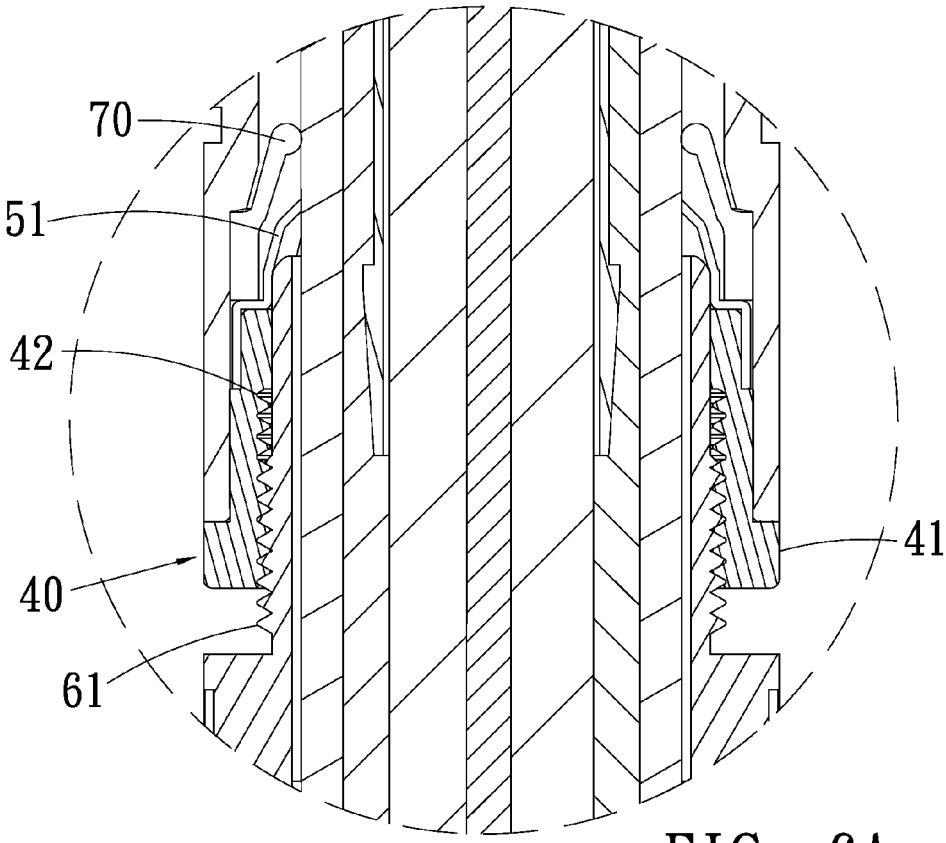
FIG. 6A is an amplified cross sectional view showing a part of the fixed cable according to the preferred embodiment of the present invention.

Referring to FIGS. 1-6 and 6A, a joint structure for a cable in accordance with a preferred embodiment of the present invention includes a connecting sleeve 10, an internal tube 20, an outer fitting member 30, a sheath member 40, a stopping loop 50, a screwed sliding member 60, and a waterproof sleeve 70, wherein the outer fitting member 30, the sheath member 40, the screwed sliding member 60, and the waterproof sleeve 70 are made of plastic material.

The connecting sleeve 10 is formed in an annular tube shape, and includes threads 11 formed around an inner wall of an opening of an upper end thereof to be screwed to an entry of an electronic device, and includes a shoulder 12 extending around a bottom end of the inner wall thereof, and includes a locking section 13 mounted on an outer wall thereof and formed in a hexagon shape to correspond to an allen wrench.

The internal tube 20 is fitted to the connecting sleeve 10 and formed in a hollowly elongated tube shape to be inserted into a core segment of the cable, and includes an arresting ring 21 extending outward around an upper end thereof to abut against the shoulder 12 of the connecting sleeve 10 and so as to prevent the connecting sleeve 10 from sliding out of the internal tube 20, and includes a circular groove 22 arranged around an outer wall thereof.

The outer fitting member 30 is a hollow housing, and includes an orifice formed on a bottom end thereof, and includes a hole 31 disposed on a top surface thereof, the hole 31 includes a circular projection 311 formed around an inner surface thereof to correspond to the circular groove 22 of the internal tube 20 such that the outer fitting member 30 is fitted to the outer wall of the internal tube 20 by using the hole 31 and further enable to rotate the connecting sleeve 10.

The sheath member 40 is formed in a tube shape and used to plug into the orifice of the bottom end of the outer fitting member 30 and inserted into the outer fitting member 30, includes an arrest rib 41 extending around a bottom end thereof to correspond to the bottom end of the outer fitting member 30, and includes a threaded section 42 mounted around an inner wall thereof.

The stopping loop 50 is fixed on a top end of the sheath member 40 and formed in a hollowly circular tube shape, includes a plurality of resilient paws 51 radially arranged around an upper end thereof and spaced apart from each other, the resilient paws 51 are titled inward and made of metal material.

The screwed sliding member 60 is formed in an elongated tube shape, includes one end inserted into the sheath member 40 and the stopping loop 50, includes a screwed portion 61 disposed around an outer wall thereof to screw with the threaded section 42 of the sheath member 40 so as to slide in the sheath member 40 and the stopping loop 50, and when the screwed sliding member 60 slides, it allows to selectively push the resilient paws 51 of the stopping loop 50 so that the resilient paws 51 are expanded outward. The screwed sliding member 60 also includes a rotating portion 62 mounted on a bottom end thereof to be manually rotated by a user.

The waterproof sleeve 70 is fitted to the upper end of the stopping loop 50.

In operation, the prepared cable is inserted into the screwed sliding member 60 and inserted through the sheath member 40 and the stopping loop 50, and then the cable is pushed so that the core segment of the cable is inserted through the internal tube 20 to be about to contact with the electronic device. In the meantime, the cable allows to be moved upward and downward. Thereafter, the screwed sliding member 60 is rotated to move downward so that the resilient paws 51 of the stopping loop 50 return original positions to be further pushed to retain in a cable jacket securely.

While we have shown and described various embodiments in accordance with the present invention, it is clear to those skilled in the art that further embodiments may be made without departing from the scope of the present invention.

What is claimed:

1. A joint structure for a cable comprising:

a connecting sleeve formed in an annular tube shape, and including threads formed around an inner wall of an opening of an upper end thereof, and including a shoulder extending around a bottom end of the inner wall thereof;

an internal tube fitted to the connecting sleeve and formed in a hollowly elongated tube shape, and including an arresting ring extending outward around an upper end thereof to abut against the shoulder of the connecting sleeve, and including a circular groove arranged around an outer wall thereof;

an outer fitting member being a hollow housing, and including an orifice formed on a bottom end thereof, and including a hole disposed on a top surface thereof, the hole including a circular projection formed around an inner surface thereof to correspond to the circular groove of the internal tube such that the outer fitting member is fitted to the outer wall of the internal tube by using the hole and further enable to rotate the connecting sleeve;

a sheath member formed in a tube shape and used to plug into the orifice of the bottom end of the outer fitting member and inserted into the outer fitting member, including an arrest rib extending around a bottom end thereof to correspond to the bottom end of the outer fitting member, and including a threaded section mounted around an inner wall thereof;

a stopping loop fixed on a top end of the sheath member and formed in a hollowly circular tube shape, including a plurality of resilient paws radially arranged around an upper end thereof and spaced apart from each other, the resilient paws being titled inward;

a screwed sliding member formed in an elongated tube shape, including one end inserted into the sheath member and the stopping loop, including a screwed portion disposed around an outer wall thereof to screw with the threaded section of the sheath member so as to slide in the sheath member and the stopping loop, and when the screwed sliding member slides, it allows to selectively push the resilient paws of the stopping loop so that the resilient paws are expanded outward.

2. The joint structure for the cable as claimed in claim 1, wherein the outer fitting member, the sheath member, and the screwed sliding member are made of plastic material.

3. The joint structure for the cable as claimed in claim 2, wherein the resilient paws are titled inward and made of metal material.

4. The joint structure for the cable as claimed in claim 1, wherein the waterproof sleeve is fitted to the upper end of the stopping loop.

5. The joint structure for the cable as claimed in claim 2, wherein the waterproof sleeve is fitted to the upper end of the stopping loop.

6. The joint structure for the cable as claimed in claim 3, wherein the waterproof sleeve is fitted to the upper end of the stopping loop.

7. The joint structure for the cable as claimed in claim 4, wherein the connecting sleeve includes a locking section mounted on an outer wall thereof.

8. The joint structure for the cable as claimed in claim 5, wherein the connecting sleeve includes a locking section mounted on an outer wall thereof.

9. The joint structure for the cable as claimed in claim 6, wherein the connecting sleeve includes a locking section mounted on an outer wall thereof.

10. The joint structure for the cable as claimed in claim 7, wherein the screwed sliding member includes a rotating portion mounted on a bottom end thereof.

11. The joint structure for the cable as claimed in claim 8, wherein the screwed sliding member includes a rotating portion mounted on a bottom end thereof.

12. The joint structure for the cable as claimed in claim 9, wherein the screwed sliding member includes a rotating portion mounted on a bottom end thereof.

* * * * *